US005271621A

United States Patent [19]

Lo

[11] Patent Number: 5,271,621

[45] Date of Patent: Dec. 21, 1993

[54] GOLF CLUB HEAD

[76] Inventor: Kun-Nan Lo, No. 33, Hsiang-Ho Rd., Li-Lin Tsun, Tan-Tzu Hsiang, Taichung Hsien, Taiwan

[21] Appl. No.: 9,572

[22] Filed: Jan. 26, 1993

[51] Int. Cl.[5] ..... A63B 53/04

[52] U.S. Cl. ..... 273/167 H; 273/173; 273/DIG. 23; 273/78

[58] Field of Search ..... 273/167 R-77 A, 273/164.1, 193 R, 194 R, DIG. 7, DIG. 23

[56] References Cited

U.S. PATENT DOCUMENTS

| | | | |
|---|---|---|---|
| 1,562,956 | 11/1925 | Guerne | 273/78 |
| 4,398,965 | 8/1983 | Campau | 273/78 X |
| 4,429,879 | 2/1984 | Schmidt | 273/167 H |
| 4,465,221 | 8/1984 | Schmidt | 273/173 X |
| 4,804,188 | 2/1989 | McKee et al. | 273/78 X |
| 4,884,812 | 12/1989 | Nagasaki et al. | 273/78 X |
| 4,928,965 | 5/1990 | Yamaguchi et al. | 273/78 |
| 5,094,383 | 3/1992 | Anderson et al. | 273/167 H X |
| 5,106,094 | 4/1992 | Desbiolles et al. | 273/167 H |

FOREIGN PATENT DOCUMENTS

| | | | |
|---|---|---|---|
| 211781 | 12/1957 | Australia | 273/167 F |

*Primary Examiner*—Vincent Millin
*Assistant Examiner*—Sebastiano Passaniti
*Attorney, Agent, or Firm*—Matthew K. Ryan

[57] ABSTRACT

The golf club head includes a hollow main body that is made of metal and has a front side with a wall that defines a cavity at an outer surface. A projection unit is formed integrally with the periphery of the wall at an inner surface of the latter and extends into the hollow main body.

4 Claims, 4 Drawing Sheets

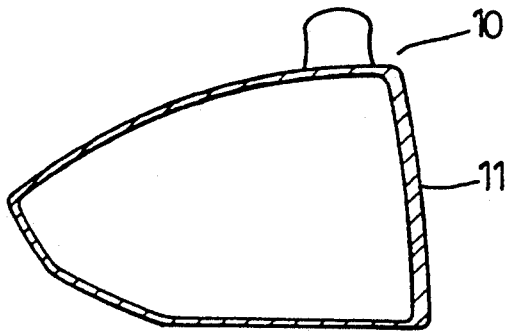
FIG.1
PRIOR ART
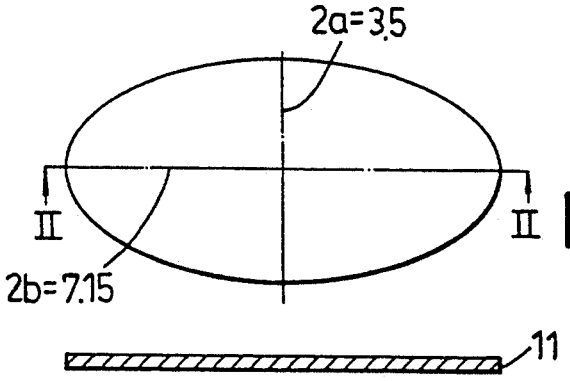
FIG.2(A)
PRIOR ART
FIG.2(B)
PRIOR ART

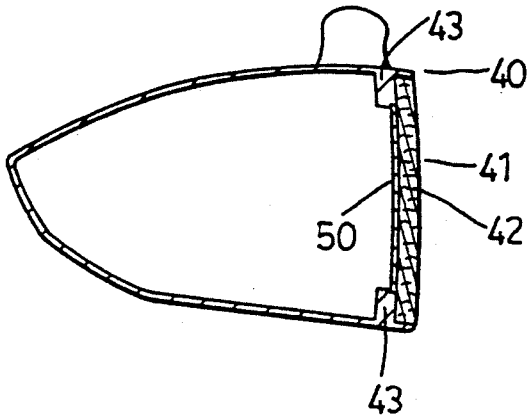
FIG.7
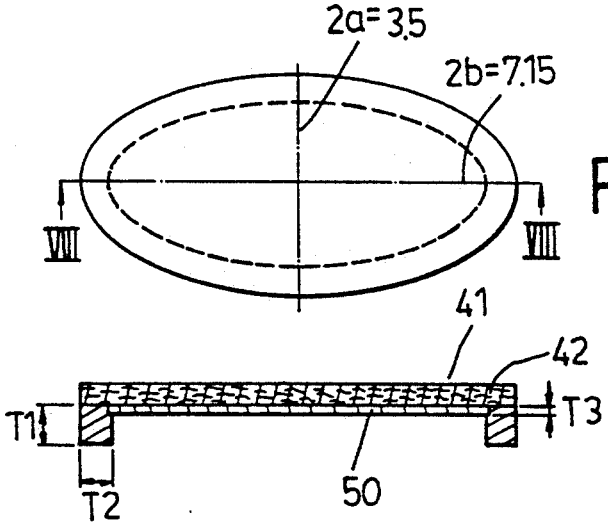
FIG.8(A)
FIG.8(B)

GOLF CLUB HEAD

BACKGROUND OF THE INVENTION

1. Field of the Invention

The invention relates to a golf club head, more particularly to a golf club head which is heavier at a front side of the golf club head.

2. Description of the Related Art

A conventional golf club head is usually made of stainless steel, which has a relatively high density. Therefore, the size of the conventional golf club head is relatively small. It is difficult to design the mass distribution of the ball hitting surface of the conventional golf club head in order to achieve the characteristics of an ideal club head, that is, to achieve the largest inertial moment so as to obtain a longer hitting distance and so as to increase the area of the sweet spot at the ball hitting surface in order to obtain an optimum ball hitting arrangement and better ball control.

Referring to FIGS. 1 and 2, a first example of a conventional golf club head is shown to include a hollow main body (10) that is made of steel and that has a front side (11) for hitting a golf ball. The front side (11) of the conventional golf club head is designed with a thickness of 0.3 cm. in order to provide a substantial degree of hardness and weight thereat. Such an arrangement results in a limited inertial moment which cannot permit a golf ball to travel a longer distance when struck by the golf club head.

To facilitate calculation, it is assumed that the front side of the golf club head is oval-shaped. The mass of the front side (11) is given by the equation:

$$M = p \cdot V$$

$$M = p \cdot \pi \cdot a \cdot b \cdot t$$

wherein "V" is the volume of the hollow main body, "p" is the density of stainless steel (7.8 g./cc), "a" is one-half of the length of the minor axis (3.5/2=1.75 cm), "b"is one-half of the length of the major axis (7.15/2=3.575 cm), and "t" is the thickness of the first side (0.3 cm).

After substituting the above variables into the given equation, the mass of the front side is equal to 45.992 g.

The inertial moment that is provided by the front side (11) of the golf club head when a golf ball is struck is determined as follows:

$$\begin{aligned} I &= M \cdot (a^2 + b^2)/4 \\ &= 45.992[(3.5)^2 + (7.15/2)^2]/4 \\ &= 182.165 \text{ g} \cdot \text{cm}^2 \end{aligned}$$

Referring to FIGS. 3 and 4, another conventional golf club head is shown to comprise a hollow main body (20) which is made of steel and which has a front side with a wall (22) that defines a cavity. A mass of carbon fiber reinforced resin material (21) (density=1.56 g./cc) fills the cavity and defines a ball hitting surface (23) at the front side. In order to obtain an optimum ball hitting distance, the wall (22) is designed to have a thickness of 0.22 cm, while the mass of resin material (21) is designed to have a thickness of 0.4 cm.

Assuming that the front side of the hollow main body (20) has an oval-shaped cross section. The mass of the front side of the golf club head is computed as follows:

$$\begin{aligned} M &= \text{the mass of the wall} + \text{the mass} \\ &\quad \text{mass of the resin material} \\ M &= \pi \cdot a \cdot b \cdot [(7.8 \times 0.22) + (1.56 \times 0.4)] \\ &= 22/7 \times 1.75 \times 3.575[(7.8 \times 0.22) + (1.56 \times 0.4)] \\ &= 45.992 \text{ g.} \end{aligned}$$

The inertial moment that is provided by the front side of the golf club head when a golf ball is struck is determined as follows:

$$\begin{aligned} I &= M(a^2 + b^2)/4 \\ &= 182.165 \text{ g} \cdot \text{cm}^2 \end{aligned}$$

From the above two examples, it is known that the two conventional golf club heads provide the same inertial moment.

SUMMARY OF THE INVENTION

A main objective of the present invention is to provide a golf club head that includes a ball hitting surface in which the mass distribution thereof is arranged in a particular manner so that the golf club head provides a longer hitting distance, better ball control, and a larger sweet spot, thereby increasing the accuracy of hitting the ball when the golf club head is in use.

The golf club head includes a hollow main body which is made of steel and which has a front side with a wall that defines a cavity which is filled with a mass of carbon fiber reinforced resin material that defines a ball hitting surface at the front side. According to the present invention, the wall at the front side is thinned, and a flange portion is formed on an inner surface of the wall and extends into the hollow main body. With this arrangement, the golf club head provides a larger inertial moment and a larger sweet spot at the ball hitting surface, thereby ensuring a longer hitting distance and better ball control will be attained when the golf club head is in use.

BRIEF DESCRIPTION OF THE DRAWINGS

Other features and advantages of the present invention will become more apparent in the following detailed description of the preferred embodiments with reference to the accompanying drawings, in which:

FIGS. 1 is a cross-sectional view of a conventional golf club head;

FIG. 2(A) illustrates the ball hitting surface of the conventional golf club head;

FIG. 2(B) is a cross-sectional view of the ball hitting surface shown in FIG. 2(B) taken along the line II—II;

FIG. 7 is a cross sectional view of another preferred embodiment of a golf club head according to the present invention; and FIG. 8(A) illustrates the ball hitting surface of the golf club head shown in FIG. 7; and FIG. 8(B) is a cross-sectional view of the ball hitting surface of the golf club head shown in FIG. 8(A) taken along the line VIII—VIII.

DETAILED DESCRIPTION OF THE PREFERRED EMBODIMENTS

Figure 3:
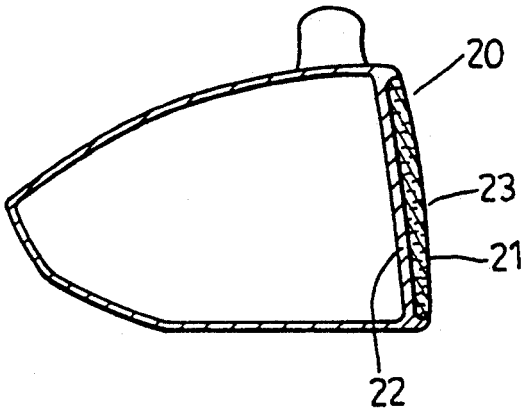
FIG. 3 PRIOR ART
FIG. 3 is a cross-sectional view of another conventional golf club head.
Figure 4A:
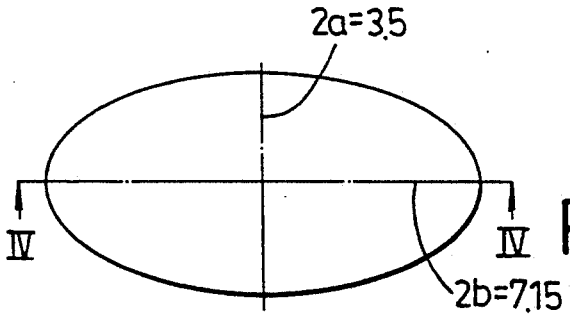
FIG. 4(A) PRIOR ART
FIG. 4(A) illustrates the ball hitting surface of another conventional golf club head shown in FIG. 3.
Figure 4B:
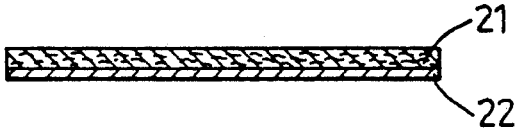
FIG. 4(B) PRIOR ART
FIG. 4(B) is a cross-sectional view of the ball hitting surface shown in FIG. 4(A) taken along the line IV—IV.
Figure 5:
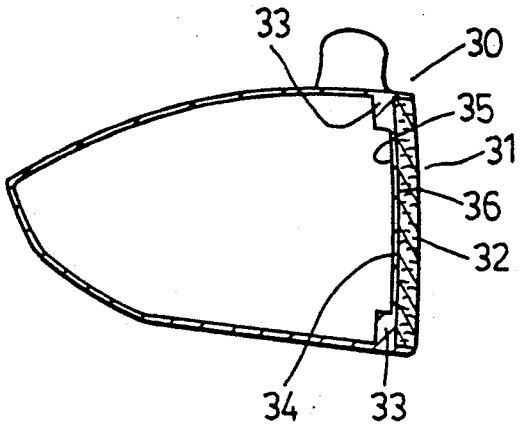
FIG. 5 is a cross-sectional view of a gold club head according to the present invention.

Referring to FIG. 5, a golf club head of the present invention is shown to comprise a hollow main body (30) which is made of steel and has a front side with a wall (34) that defines a cavity at a front surface (36) thereof. The cavity is filled with a mass of carbon reinforced resin material (32) that defines a ball hitting surface. The wall (34) has a rear surface (35) that is provided with a projection unit (33) which is formed integrally with wall (34) at the periphery of the latter and which extends into the interior of the main body (30).

In one preferred embodiment, the projection unit (33) is a continuous flange that is formed on the rear surface (35) and that extends into the main body (30). The flange surrounds an inner section which is formed integrally with the projection unit (33) and which can be substituted by any material such as aluminum, copper or plastic. The substitute material has a density that is smaller than that of steel in order to compensate for the increase in the mass due to the flange. In another embodiment, the projection unit (33) includes a plurality of protrusions which are formed on the rear surface (35) and which extends into the main body (30).

The main feature of the present invention resides in the wall at a front side of hollow main body of a golf club head. The wall has a predetermined thickness and can provide a larger inertial moment, thereby permitting a longer hitting distance and better ball control.

In the preferred embodiments, the mass of the projection unit (33) is equal to the decrease in the mass of the wall (34) due to the thinning. Therefore, the total mass of the hollow main body is the same when compared to a conventional golf club head. The golf club head (30), however, provides a larger inertial moment.

Figure 6A:
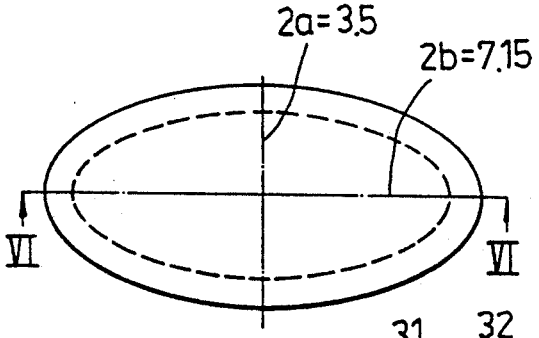
FIG. 6(A) illustrates the ball hitting surface of the golf club head shown in FIG. 5.
Figure 6B:
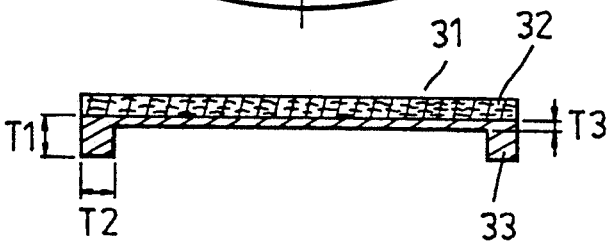
FIG. 6(B) is a cross-sectional view of the ball hitting surface of the golf club head shown in FIG. 6(A) taken along the line VI—VI.

Referring to FIG. 6, in order to provide a flange portion which has a length T1 of 0.389 cm, a width of 0.6 cm, the thickness of the deformed wall should be 0.08 cm while the wall must have a thickness T1>T3 +0.2 cm. In the following calculation, it is assumed that the hitting surface (31) of the golf club head (30) is oval-shaped with a minor axis $2a=3.5$ cm, a major axis $2b=7.15$. The thickness of the mass of carbon reinforced resin material is 0.4 cm. The total mass M' of the hitting surface (31) of the golf club head (30) can be calculated according to by the equation:

$$M' = M1(\text{the mass of the reinforced material}) + M2(\text{the mass of the wall}) + M3(\text{the mass of the projection unit})$$

Since $M = p \cdot \pi \cdot a \cdot b \cdot t$ $$M1 = 1.56 \times \pi \times (3.5/2) \times (7.15/2) \times 0.4 = 12.264 \text{ g.}$$

$$M2 = 7.8 \times \pi \times [(3.5/2 - 0.6) \times (7.15/2 - 0.6)] \times 0.08 = 6.71 \text{ g.}$$

-continued $$M3 = 7.8 \times \pi \times [(1.75 \times 3.5750 - (1.15 \times 2.975)] \times 0.389 = 27.023 \text{ g.}$$

Therefore, $M' = 12.264 + 6.71 + 27.023 = 45.997$ g.

The inertial moment that is provided by the front side of the golf club head when a golf ball is struck is determined as follows:

$$I = M(a^2 + b^2)/4$$

$$I1 = 12.264[(1.75)^2 + (3.575)^2]/4 = 48.575$$

$$I2 = 6.71[(1.15)^2 + (2.975)^2]/4 = 17.057$$

$$I3 = 7.8 \times \pi \{1.75 \times 3.7575[(1.75)^2 + (3.575)^2] - 1.15 \times 2.975[(1.15)^2 + (2.975)^2]\}/4 \times 0.389 = 153.263$$

Therefore, the total inertial moment that is provided by the hitting surface (31) of the golf club head (30) when a golf ball is struck is as follows:

$$I = 48.575 + 17.057 + 153.263 = 218.897 \text{ g·cm}^2$$

From the above calculation, it can be seen that given the same weight, when the mass distribution at the front side of the golf club head is altered according to the present invention, an inertial moment is larger than that of a conventional golf club head thus permitting a longer hitting distance and an increase in the area of the sweet spot at the hitting surface. Thus, the possibility that the ball will be struck at the sweet spot is also increased.

Referring to FIGS. 7 and 8, the wall (50) of the golf club head (40) is substituted with a material, such as aluminum which has a density that is smaller than that of steel (density of aluminum 2.7 g/cc) and a thickness of 0.0289 cm. The projection unit (43) is made of steel with a depth T1 of 0.4833 cm and a width of 0.6 cm. The reinforced resin material (42) has a thickness of 0.4 cm.

The hitting surface (41) is similar to the shape of the previous embodiment. The total mass of the hitting surface (41) of the golf club head (40) is computed as follows:

$$M' = M1(\text{mass of the reinforced resin material}) + M2[\text{mass of the wall (50)}] + M3[\text{mass of the projection unit (43)}];$$

Since $M = p \cdot \pi \cdot a \cdot b \cdot t$;

$M1 = 12.264$ g.; ($p = 1.56$, $t = 0.4$)

$M2 = 0.838$ g.; ($p = 2.7$, $t = 0.0289$)

$M3 = 32.886$ g.; ($p = 7.8$, $t = 0.4734$)

Therefore $M' = M1 + M2 + M3 = 12.264 + 0.838 + 32.886 = 45.988$ g.

Similarly $I = M(a^2 + b^2)/4$ $I1 = 48.575$ $I2 = 2.133$ $I3 = 186.509$

The total inertial moment that is provided by the hitting surface (41) of the golf club head (40) when a golf ball is struck is determined as follows:

$$I = 48.575 + 2.133 + 186.509$$
$$= 237.217\ g \cdot cm^2$$

From the above calculations, it can be seen that given the same weight, when the mass distribution at the front side of the golf club head (40) is altered according to the present invention, the inertial moment correspondingly becomes larger to result consequently in a longer hitting distance when the golf club head hits a golf ball. The features and objects are thus achieved.

With the present invention thus described, it is obvious to those skilled in the art that several modifications and variations can be made without departing from the scope and spirit thereof. It is therefore intended that the present invention should not be limited to the exact disclosure but only to the extent of the appended claims.

I claim:

1. A golf club head including a hollow main body that is made of metal and that has a front side with a wall that defines a cavity, and a mass of carbon fiber reinforced resin material that fills the cavity and that defines a ball hitting surface at the front side;

the improvement comprising: said wall further including a projection unit that extends into said main body, said projection unit being formed integrally with the periphery of said wall, wherein said projection unit both surrounds a section of said wall that is formed integrally with said projection unit and has a degree of density which is smaller than that of said metal.

2. The golf club head as defined in claim 1, wherein said projection unit is a flange that extends along the periphery of said wall.

3. The golf club head as defined in claim 1, wherein said projection unit includes a plurality of protrusions that extend along the periphery of said wall.

4. The golf club head as defined in claim 1, wherein said metal is stainless steel.

* * * * *